US006371365B1

(12) United States Patent
Doucette et al.

(10) Patent No.: US 6,371,365 B1
(45) Date of Patent: Apr. 16, 2002

(54) DISPLAY AND SHIPPING CARTON

(75) Inventors: Daniel E. Doucette, DeForest; Cynthia Lynn Wilcox, Sun Prairie, both of WI (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/745,189

(22) Filed: Dec. 21, 2000

(51) Int. Cl.[7] ..... B65D 5/54
(52) U.S. Cl. ..... 229/120.011; 229/240
(58) Field of Search ..... 229/120.011, 120.012, 229/164, 240, 242; 206/736

(56) References Cited

U.S. PATENT DOCUMENTS

| | | | | |
|---|---|---|---|---|
| 2,085,827 A | | 7/1937 | Perreton | |
| 2,218,509 A | | 11/1940 | Goodyear | |
| 2,751,964 A | | 6/1956 | Guyer | 154/33.05 |
| 2,973,130 A | * | 2/1961 | Cottrill | 229/120.011 |
| 3,090,483 A | | 5/1963 | Altree et al. | |
| 3,136,474 A | | 6/1964 | Schaus et al. | |
| RE25,856 E | | 9/1965 | Boitel | |
| 3,241,737 A | | 3/1966 | Steinbock | |
| 3,314,587 A | | 4/1967 | Johnson | |
| 3,425,537 A | | 2/1969 | Miller | |
| 3,687,278 A | | 8/1972 | Graham et al. | |
| 3,786,914 A | | 1/1974 | Beutler | |
| 3,892,348 A | * | 7/1975 | Rohner | 229/120.011 |
| 4,256,223 A | | 3/1981 | Pawlowski | 206/45.11 |
| 4,263,769 A | * | 4/1981 | Hanazawa et al. | 229/120.012 |
| 4,533,052 A | * | 8/1985 | Fruchey et al. | 229/120.011 |
| 4,746,010 A | | 5/1988 | Fournier | 206/45.14 |
| 4,778,057 A | | 10/1988 | Allen et al. | |
| 4,784,291 A | | 11/1988 | Melucci | 221/187 |
| 4,871,067 A | * | 10/1989 | Valenti | 229/164 |
| 4,919,269 A | * | 4/1990 | Wright et al. | 229/120.011 |
| 5,012,929 A | * | 5/1991 | Roosa | 229/240 |
| 5,129,575 A | * | 7/1992 | Bryan | 229/120.011 |
| 5,249,738 A | | 10/1993 | Werth | 119/235 |
| 5,299,733 A | | 4/1994 | Werth | 229/120.011 |
| 5,722,583 A | * | 3/1998 | Focke et al. | 229/120.011 |
| 6,027,017 A | * | 2/2000 | Kuhn et al. | 229/120.011 |

FOREIGN PATENT DOCUMENTS

| | | | | |
|---|---|---|---|---|
| EP | 481695 A1 | * | 4/1992 | 229/120.011 |

* cited by examiner

*Primary Examiner*—Gary E. Elkins
(74) *Attorney, Agent, or Firm*—Fitch, Even, Tabin & Flannery

(57) ABSTRACT

A carton for display and shipping of product units includes two or more carton portions disposed side-by-side and a one-piece lid member spanning the carton portions. A line of weakness divides the lid member into portions corresponding to each carton portions. The lid member and carton portions include weakening so as to facilitate tear out with a simple manipulation by the user. A single carton unit is also disclosed.

20 Claims, 8 Drawing Sheets

DISPLAY AND SHIPPING CARTON

BACKGROUND OF THE INVENTION

1. Field of the Invention

The invention pertains to cartons adapted for both shipping and display.

2. Description of the Related Art

Over the years, numerous arrangements have been proposed for cartons which are suitable for shipping and which can also be adapted for use in a display setting. One challenge has been to minimize the amount of paperboard material used in such arrangements, and advances are continually being sought. While interests of manufacturing efficiency have been given considerable attention, it is also necessary to maintain the attractiveness of the carton, especially when the carton is to be put on display to consumers either at a point of sale, or within a store interior.

At times, cartons in commercial use are directed to different types of recipients. For example, cartons holding a larger quantity of commercial items may be directed to merchandisers or stores, and the quantity of commercial items contained in the carton may be so large as to be inappropriate for sales to individual consumers. It is therefore desirable that a carton arrangement intended for both commercial merchandising as well as consumer sales be readily reconfigurable to accommodate both types of users. It is important in this regard, especially when considering consumer displays, that cartons employed for such displays remain neat and attractive after the carton assembly is divided into component part-s and parts are removed to adapt the carton components ready for display. Of particular concern is the preservation of art work carried on outer liners of the carton material, since these surfaces are visible to the consumer and play a significant role in attracting the consumer's interest.

SUMMARY OF THE INVENTION

The invention is directed to substantially flat-sided containers made from unitary carton blanks of paperboard, corrugated board or other suitable materials, such as plastic. The blanks are folded and adhesively secured or otherwise fastened to form enclosed cartons of familiar shape, having six rectangular side walls. The cartons are constructed to withstand the rigors of shipping multiple commercial items. The cartons are also adapted for ready conversion into a point of sale display, presenting the commercial units within the cartons in an attractive display.

It is an object of the invention to provide a carton for display and shipping of product units.

Another object of the invention is to provide a carton of the above-described type which is readily divisible into two or more components.

A further object of the invention is to provide a carton of the above-described type which is readily converted into a display mode without sacrificing attractiveness of graphics and other information carried on the carton exterior.

These and other objects according to principles of the present are provided in a carton for display and shipping of product units, comprising carton portions disposed side-by-side. Each said carton portion has opposed side walls, opposed front and back walls and a bottom wall, cooperating to form an open top receptacle. The said carton portion front walls include removable panels and a monolithic lid member includes a front wall covering the front walls of said carton portions, an opposed back wall covering the back walls of said carton portions and a top wall covering said carton portions. The front wall of said lid member includes a first removable zipper strip partially covering the front walls of the said carton portions, and the back wall of said lid member includes a second removable zipper strip partially covering the back walls of the said carton portions. The lid member top wall defines a line of weakness generally aligned with adjacent, side-by-side sidewalls of said carton portions, so that, with removal of said first and said second zipper strips, individual closed carton members are formed.

Further objects of the invention are attained in a carton of the above-described type in which removable panels of the carton portions include pull tabs which are exposed by recesses formed in the lid member front wall so that, with a removable zipper strip removed, the front wall of the lid member and the removable are removed as a unit, re-configuring the carton portions for display in a single action.

DETAILED DESCRIPTION OF THE PREFERRED EMBODIMENTS

Figure 1:
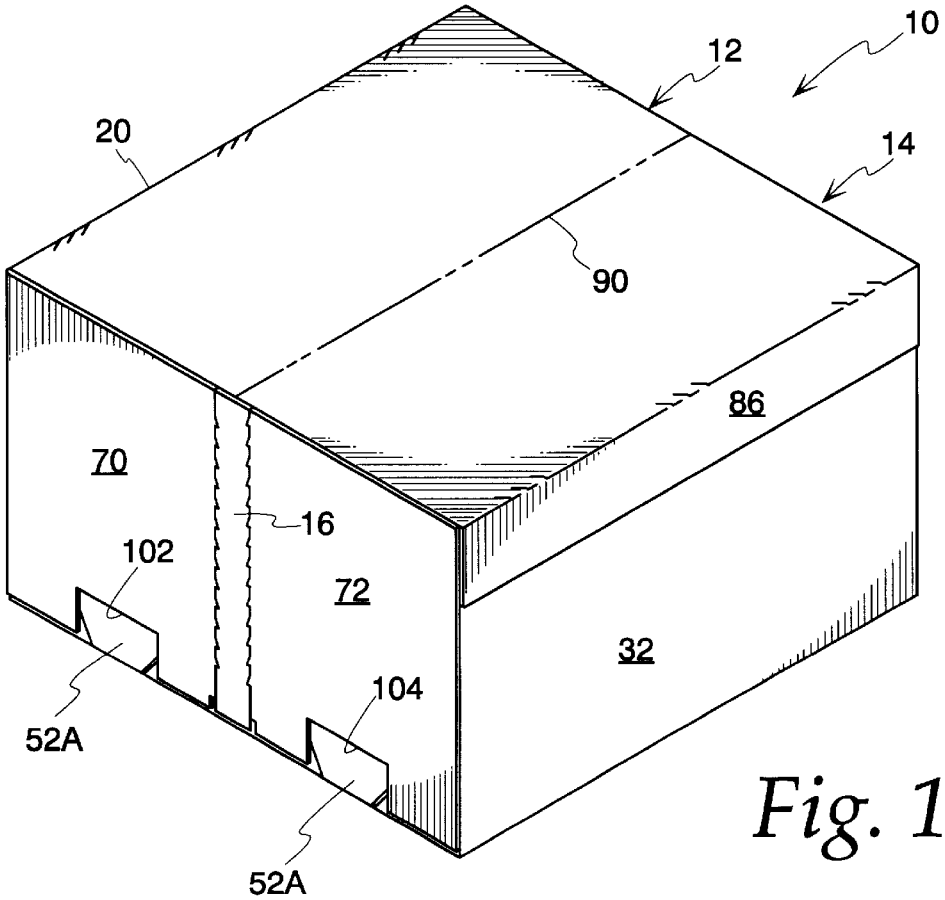
FIG. 1 is a perspective view of a carton arrangement according to principles of the invention.

FIG. 1 is a perspective view of a carton arrangement 10 according to principles of the present invention. Visible in FIG. 1 is a pair of carton components 12, 14 and a common front zipper strip 16. Not visible in FIG. 1 is a rear zipper strip 18 (see FIG. 8) similar in size to front zipper strip 16, and which is also aligned so as to overlie portions of both carton components.

Figure 3:
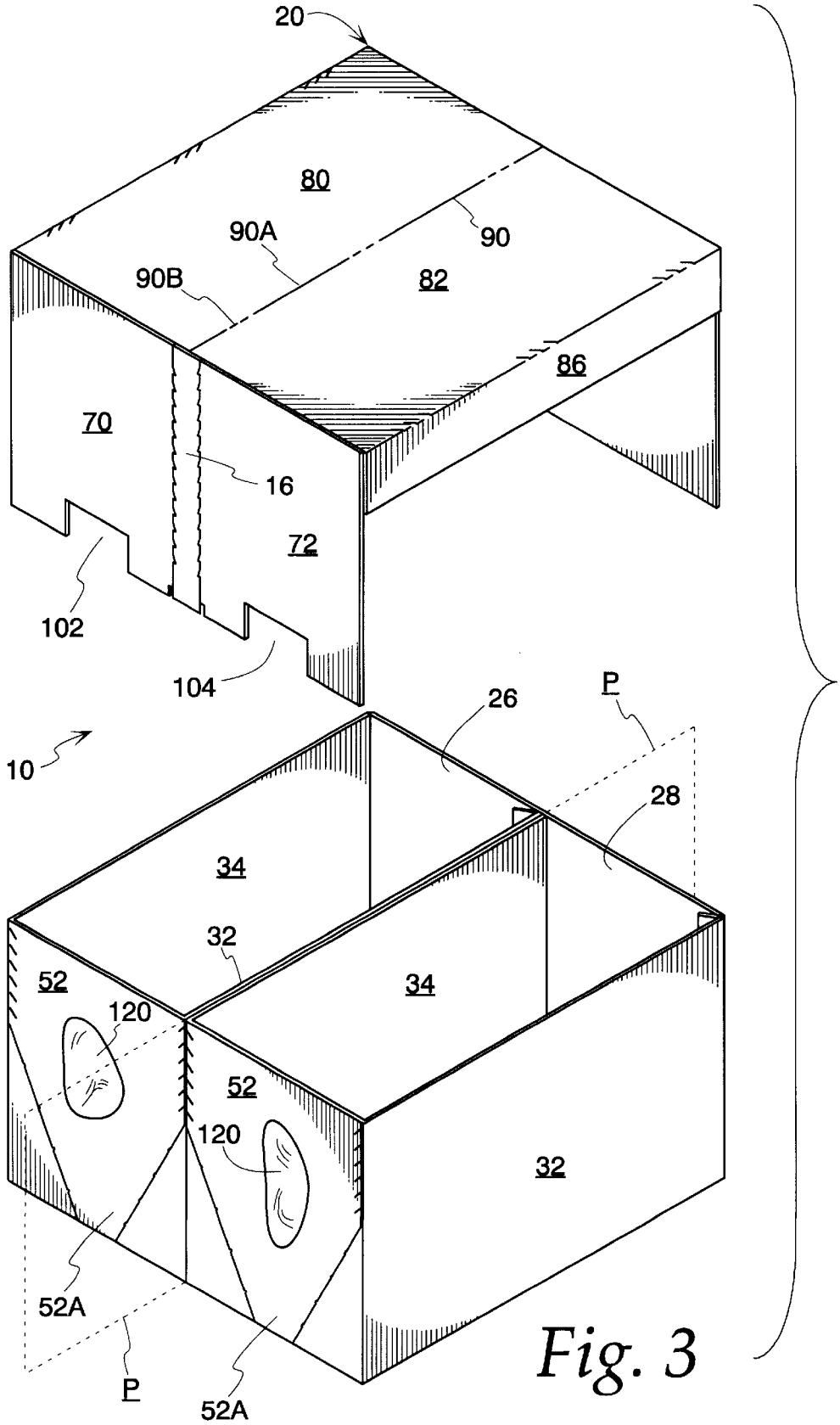
FIG. 3 is an exploded perspective view of the carton arrangement of FIG. 1.

FIG. 3 shows the carton arrangement 10 in an exploded view. Included is a lid 20, preferably of monolithic construction, formed by folding the unitary carton blank 22 of FIG. 8.

FIG. 3 shows a pair of carton receptacles 26, 28 which are preferably of identical construction. The carton receptacles 26, 28 are placed side-by-side with opposed walls 32, 34 lying along a common vertical plane P as will be mentioned below.

Figures 4, 5:
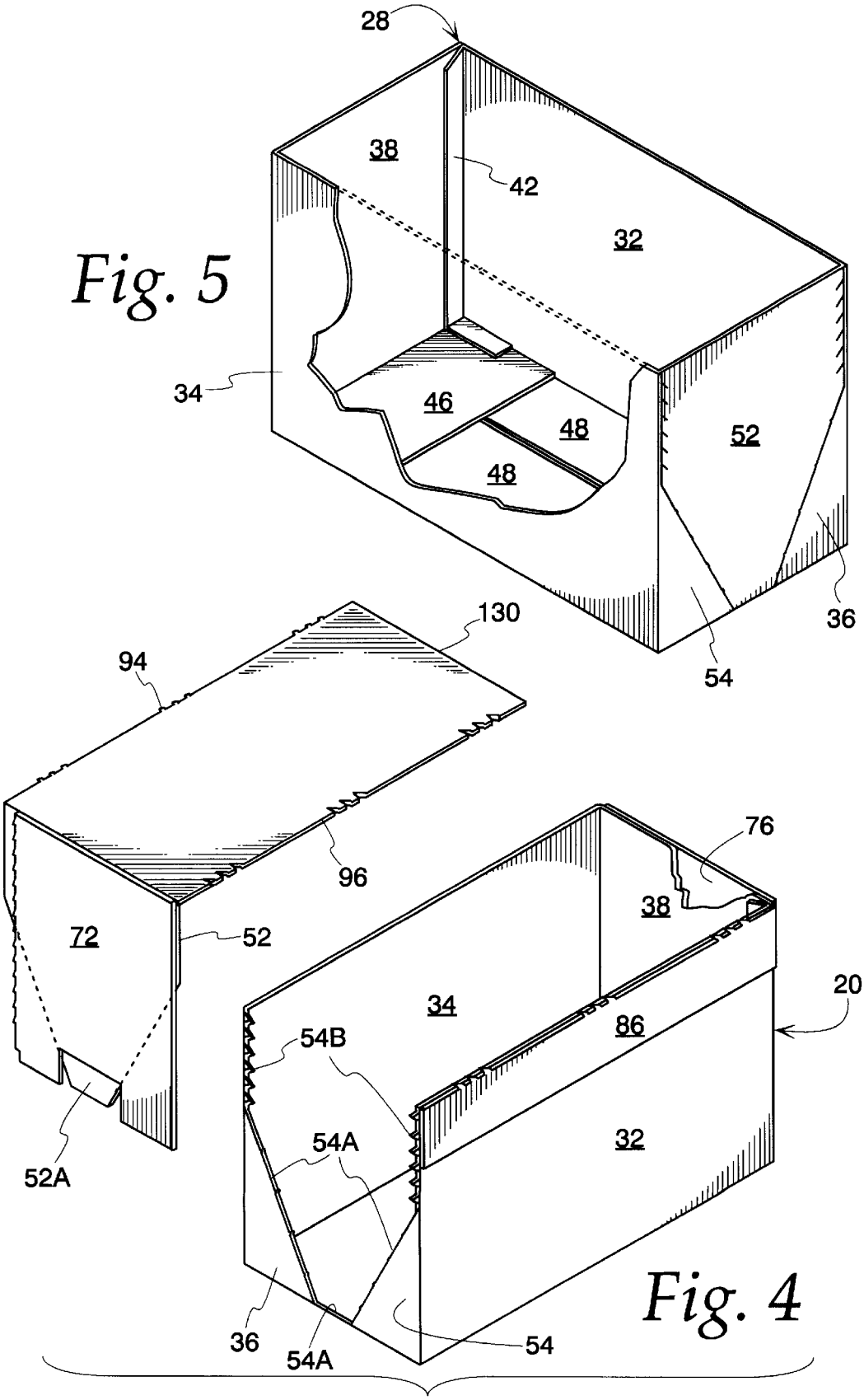
FIG. 4 is an exploded perspective view of the carton component of FIG. 2.
FIG. 5 shows the receptacle portion thereof, partly broken away.
Figure 6:
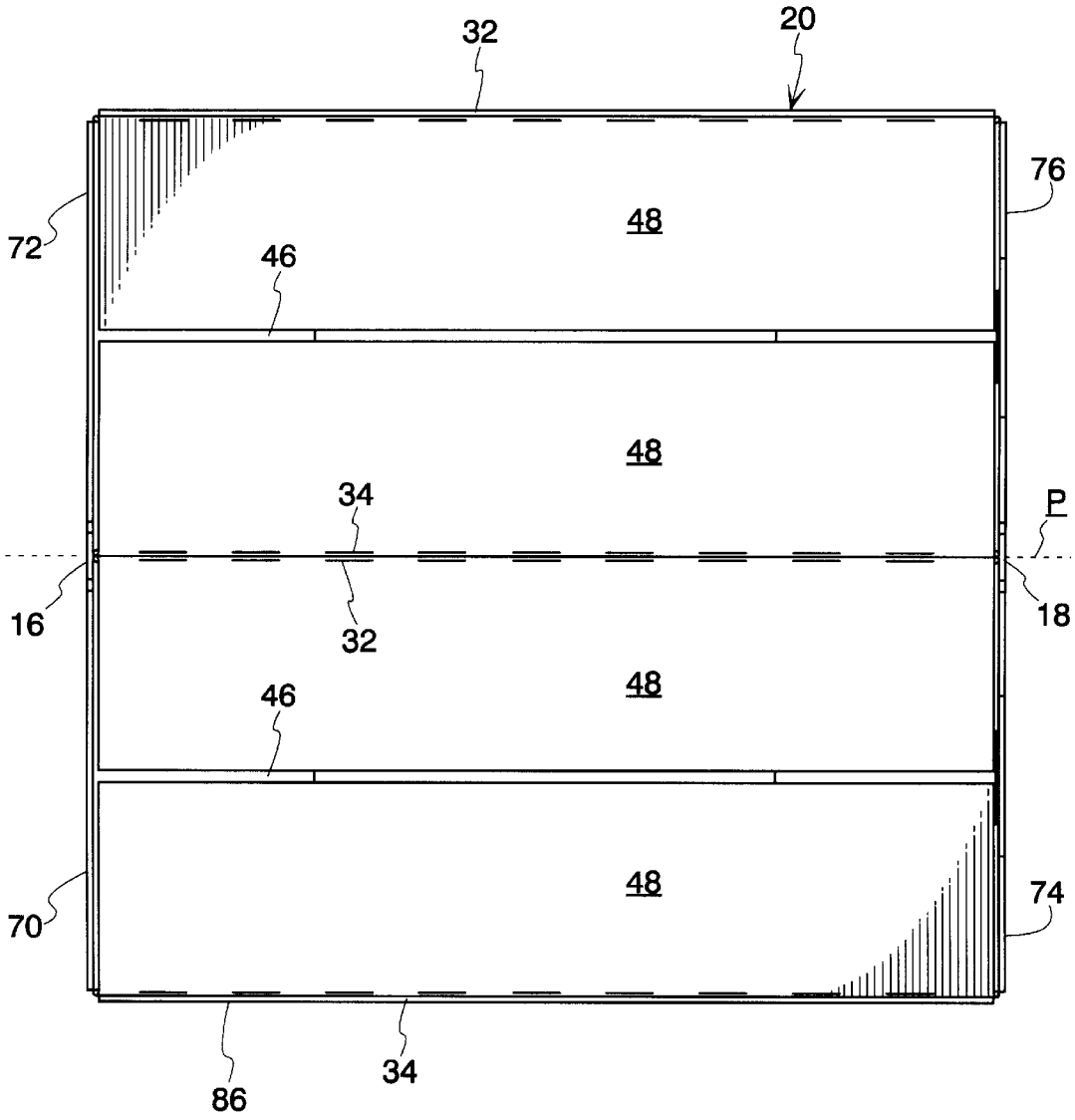
FIG. 6 is a bottom plan view of the carton arrangement of FIG. 1.

Referring to FIG. 5, carton receptacle 28 has a pair of opposed side walls 32, 34 and a pair of opposed front and rear walls 36, 38, respectively. Side wall 32 and rear wall 38 are joined together by a manufacturers joint 42. Carton receptacle 28 further includes minor bottom flaps 46 (only one is visible in FIG. 5) and a pair of major bottom flaps 48. As shown in FIG. 5, manufacturer's joint 42 extends to overlie bottom flap 46 and preferably is secured thereto with adhesive or other conventional joining means.

Referring to FIGS. 4 and 5, front wall 36 includes a removable panel 52 of generally pentagonal shape and a pair of generally triangular front wall portions 54. As can be seen by comparing FIGS. 4 and 5, with extraction of removable panel 52 carton receptacle 20 is left with relatively smooth edges 54*a* and slightly rougher sawtooth edges 54*b*. Edges 54*a* can be formed with a straight or a micro-perf cut in the carton blank, while edges 54*b* are formed by a series of short diagonal or "sawtooth" cuts in the carton blank. If desired, the bottom of panel 52 may extend slightly into the bottom floor to provide an enhanced grasping of the pull tab.

The carton receptacles shown in FIGS. 4 and 5 have found immediate commercial use in holding a plurality of commercial items, such as pre-packaged food products which are stacked in a vertical orientation. With the removable panel extracted, as shown for example in FIG. 4, the foremost commercial item is made visible to a purchaser, while the generally triangular walls 54 retain the commercial items within the receptacle.

Figure 2:
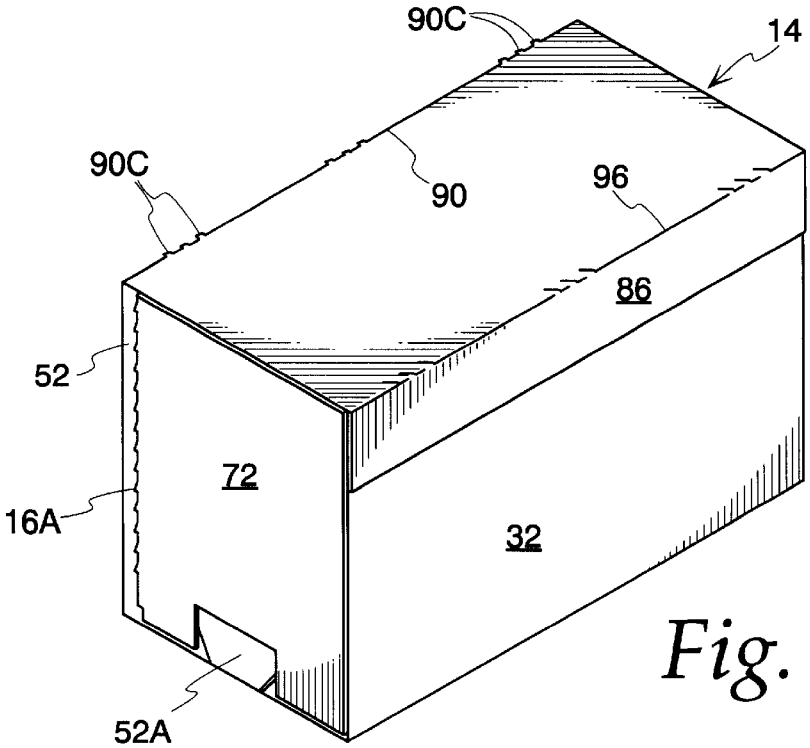
FIG. 2 is a perspective view of a carton component.

The invention allows the carton arrangement to be configured into a pair of carton components, an example of which is shown in FIG. 2. As can be seen in FIG. 2, the open top receptacle of FIGS. 4 and 5 is closed, protecting the receptacle contents and preparing the receptacle for shipment or further handling prior to conversion into the form shown in FIG. 4, ready for commercial display. Referring to FIG. 3, a pair of carton receptacles are employed in the preferred embodiment, and are joined together by a common lid member 20. As shown in FIG. 3, lid member 20 includes a pair of front walls 70, 72 aligned on either side of front zipper strip 16. An identical arrangement is formed by back walls 74,76 and back zipper strip 18 (see FIG. 8). The invention can also accommodate three or more carton components, if desired.

Figure 8:
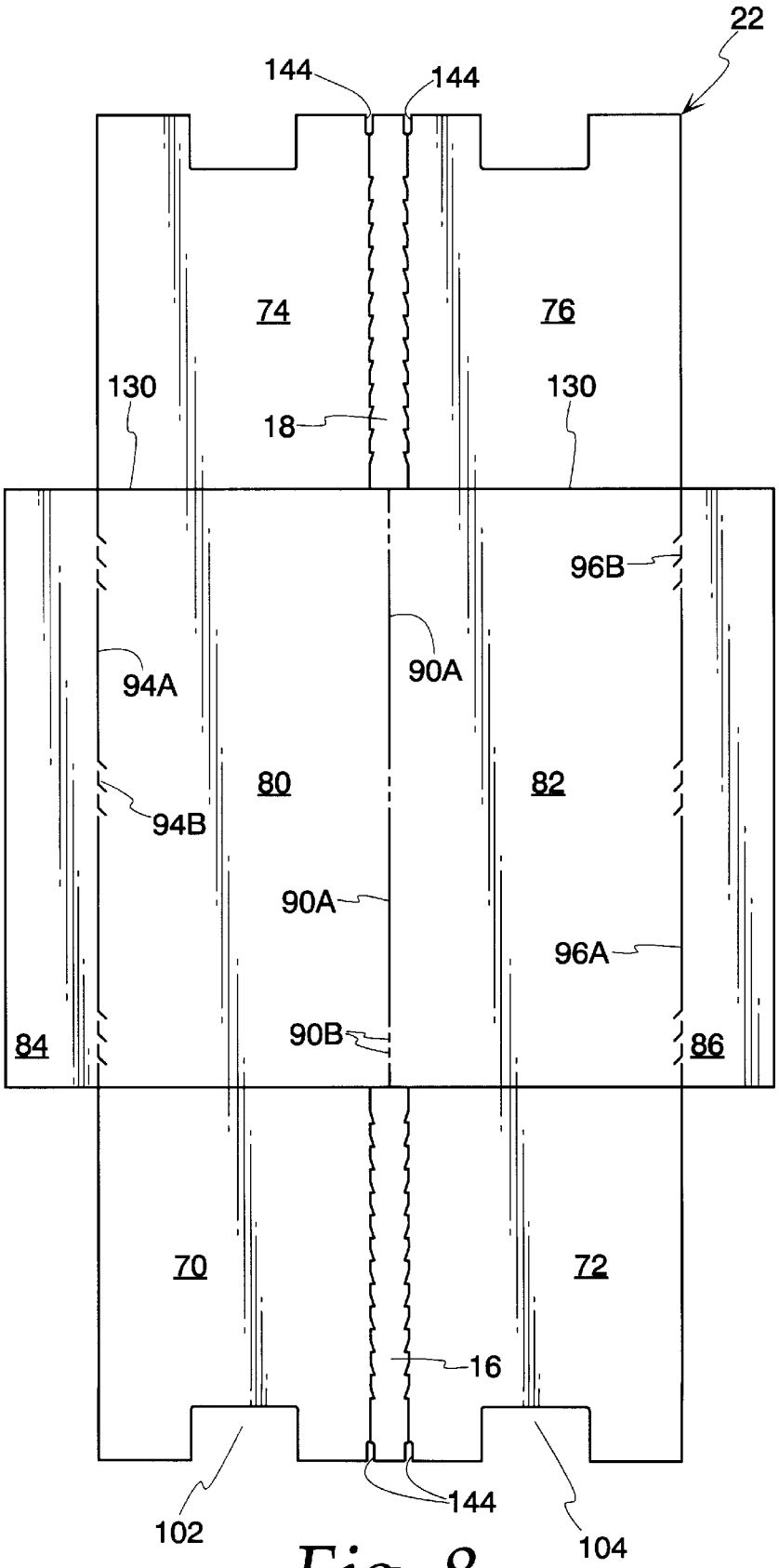
FIG. 8 is a top plan view of a blank from which the lid portion of FIG. 3 is formed.

As can be seen in FIG. 3, lid member 20 further includes top walls 80, 82 and side margins 84 (see FIG. 8) and 86 (visible in FIGS. 3 and 8, for example). Top walls 80, 82 are joined by a line of weakness 90. As can be seen in FIGS. 3 and 8, for example, line of weakness 90 is preferably formed by a repeating series of long cut portions 90*a* spaced from short cut portions 90*b*. It is generally preferred that the major portion of line of weakness 90 be completely severed, leaving only relatively short bridging portions 90*c* between the lines 90*a*, 90*b* so as to control tearing of the top walls when carton arrangement 10 of FIG. 1 is divided into carton components shown in FIG. 2.

Referring to FIGS. 3 and 8, side margins 84, 86 are joined to top wall 80, 82 by lines of weakness 94, 96 which include longer straight cut portions 94*a*, 96*a* spaced apart by sawtooth portions 94*b*, 96*b*. This provides a controlled tearing of the top walls away from the side margins leaving an attractive edge, as indicated in FIG. 4. The side margins can be omitted, if desired, but it has been found advantageous in substantially increasing the compression strength of the carton, as well as keeping the carton components square and true. Additionally, by employing side margins the carton assembly (before division into carton components) provides a complete enclosure of the receptacle contents and again, to increase compressing strength and to reduce "racking" of the carton components during shipment. It will be readily appreciated by those in the packaging art, that the design of applicant's carton lid and carton components allow simple, cost effective automated assembly techniques, suitable for use in high production form and fill application.

Figure 7:
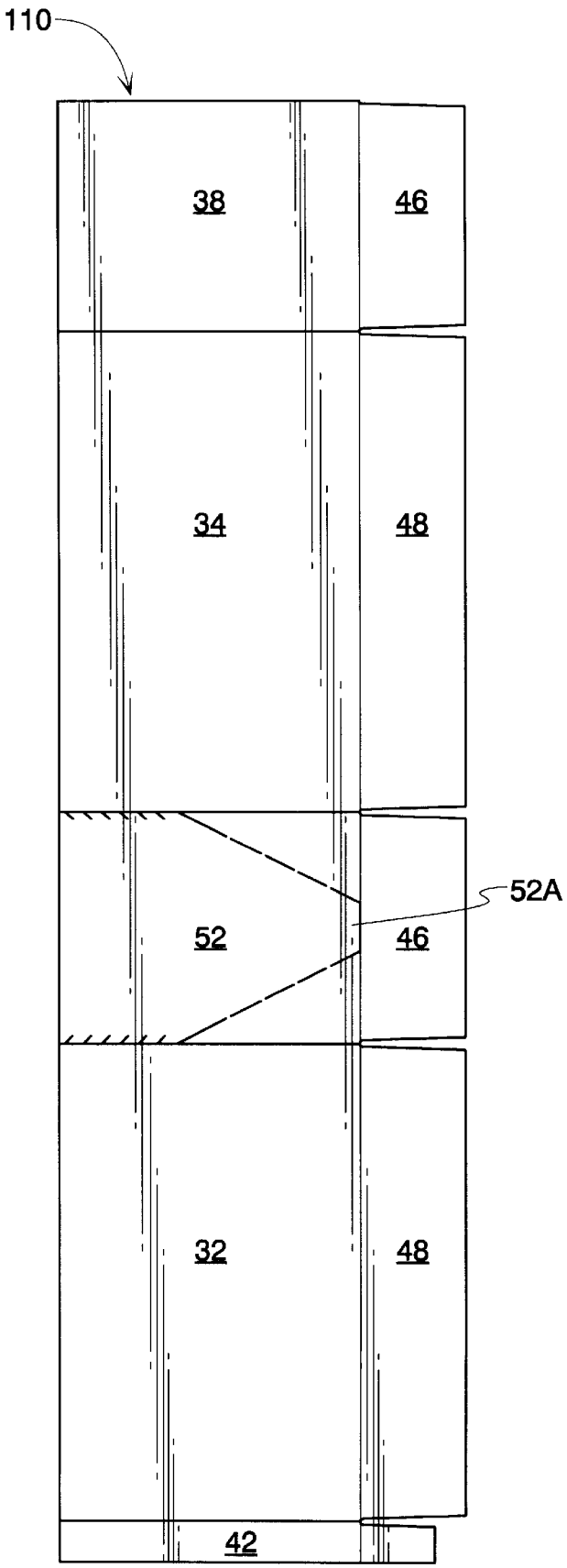
FIG. 7 is a plan view of a blank from which the carton receptacle of FIG. 5 is formed.

Referring to FIG. 1, front panels 70, 72 of lid 20 have cut-out portions 102, 104 exposing the lower pull tab portions 52*a* of removable panels 52. Preferably, the lower portions 52*a* are formed by a straight cut in carton blank 110 (see FIG. 7). This features allows portions 52*a* to serve as pull tabs which are exposed by cut-outs 102, 104. After removal of zipper strips 16, 18, a user can divide the carton arrangement 10 of FIG. 1 by tearing along line 90, forming a pair of carton components such as the right hand carton component 14 shown in FIG. 2. A user can then forward the carton component to a desired destination, or can convert the carton component into the display receptacle shown in FIG. 4.

With reference to FIG. 3, adhesive portions 120 secure the removable panel 52 to front panels 70, 72 of lid 20. As a user grasps pull tab 52*a*, both the removable panel and the front wall 72 are manipulated as a single unit, causing removable panel 52 to be extracted, leaving the front wall in the condition shown in FIG. 4. With continued tearing, top wall 82 is separated along lines of weakness 94, 96. Referring to FIG. 8, lines of weakness 130 are included in the preferred embodiment, to allow rear walls 74, 76 of lid 22 to remain secured to back walls 38 of the carton receptacles in the manner indicated in FIG. 4. Preferably, side margin 86 remains with the display receptacle, and is preferably secured to wall 32 using adhesive or other conventional joining means.

The invention meets the need to provide a shipper/display carton with an easy open feature but which is strong enough to maintain its integrity throughout distribution. The opening feature is easily performed without use of tools or special skills. Further, the opening feature provides a clean tear which does not deface the remaining board stock facing or leave behind an excessive amount of material from an area where zipper strips and other opening items are removed.

Turning now to FIGS. 1, 2 and 8, recesses 144 are provided on either end of zipper strip 16,at the lower end, where tearing is initiated. It should be noted that the front and rear zipper strip extend only to the top wall of lid member 22. The relatively short length of the zipper strips 16, 18, their sawtooth edges and the recesses 144 cooperate to form relatively "clean" non-ragged edges, such as the edge 16*a* in FIG. 2, thus preserving the integrity of the outer liner forming the carton components. As mentioned above, the preferred line of weakness 90 with relatively spaced apart bridging portions 90*c* (see FIG. 2) further contributes to the attractiveness of the carton component, when split from carton assembly 10.

According to one aspect of the present invention, the tear strips 16, 18 and lines of weakness are limited in length in order to restrain the direction of tearing, during conversion of the carton into separate carton components, and again when the carton components are converted into a display receptacle. For example, it was found that zipper strips longer than those provided in the invention had a likelihood of "wandering" so as to intrude into the outer facing of the carton. Further, it is easier for a user to align the direction of tearing if the zipper strip is made relatively short. In addition, the particular sawtooth type of cuts forming the zipper strip were found to provide improved, clean tears.

It should be noted that a zipper strip has not been provided on the top wall of the carton lid. The zipper strip on the carton top was omitted in order to prevent a longer, uncontrollable tearing, and because it would remove material covering the interior of the carton receptacle. It was found that straight line perforations, particularly those of the type described above with regard to reference numeral 90, offer an easy separation of carton components, without exposing the carton interior.

Figures 9, 10:
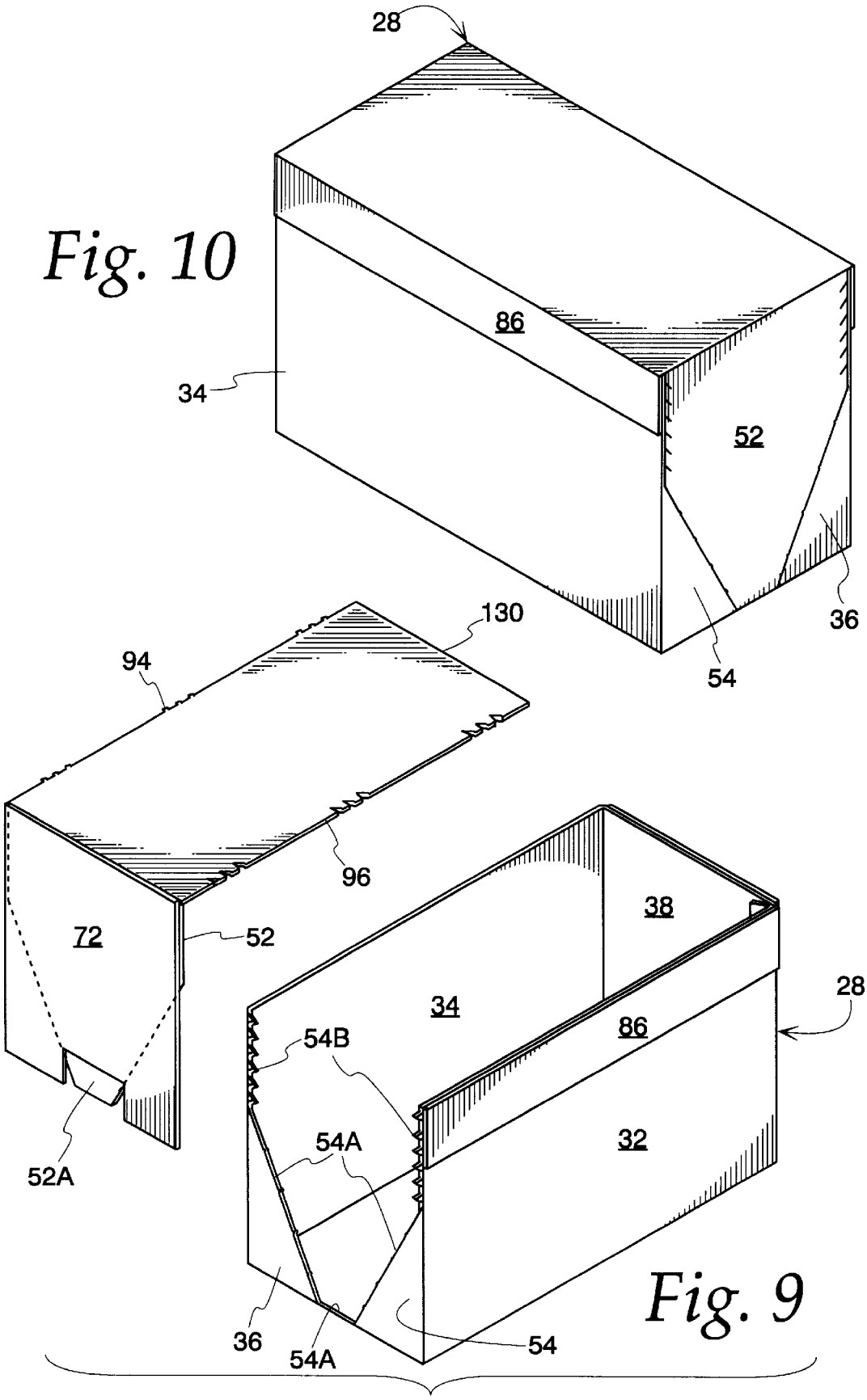
FIG. 9 is an exploded perspective view of another carton arrangement according to principles of the invention.
FIG. 10 is a perspective view thereof.

Referring now to FIGS. 9 and 10, an alternative single-unit embodiment is shown. Referring to FIG. 10, the single unit carton 28 has a pair of side margins 86 (each side margin numbered in FIGS. 9 and 10, respectively). Removable panel 52, when removed from the carton receptacle 28 leaves relatively smooth edges 54*a* and slightly rougher sawtooth edges 54*b*. The lid member includes a front wall 72, shown in FIG. 9, which overlies removable panel 52 (shown in FIG. 10) having a bottom portion 52A which forms an exposed pull tab, as shown in FIG. 9. Front wall 72 is omitted in FIG. 10, for clarity.

As shown in FIGS. 9 and 10, the carton arrangement is formed as a single unit and can accordingly accommodate customers who do not require the product quantities otherwise provided with a double unit package, as described above. However, as with the preceding double unit package, the single unit package, when prepared for dispensing on a store shelf (as illustrated, for example, in FIG. 9) provides an attractive appearance, minimizing damage to artwork contained on the package exterior. The triangular front wall portions 54 (see FIG. 9) allow convenient retention of a product unit spanning the width of the carton receptacle while allowing a user to grasp the mid-portion of the product unit. Other features are the same as described above with reference to the same reference numerals.

Figure 11:
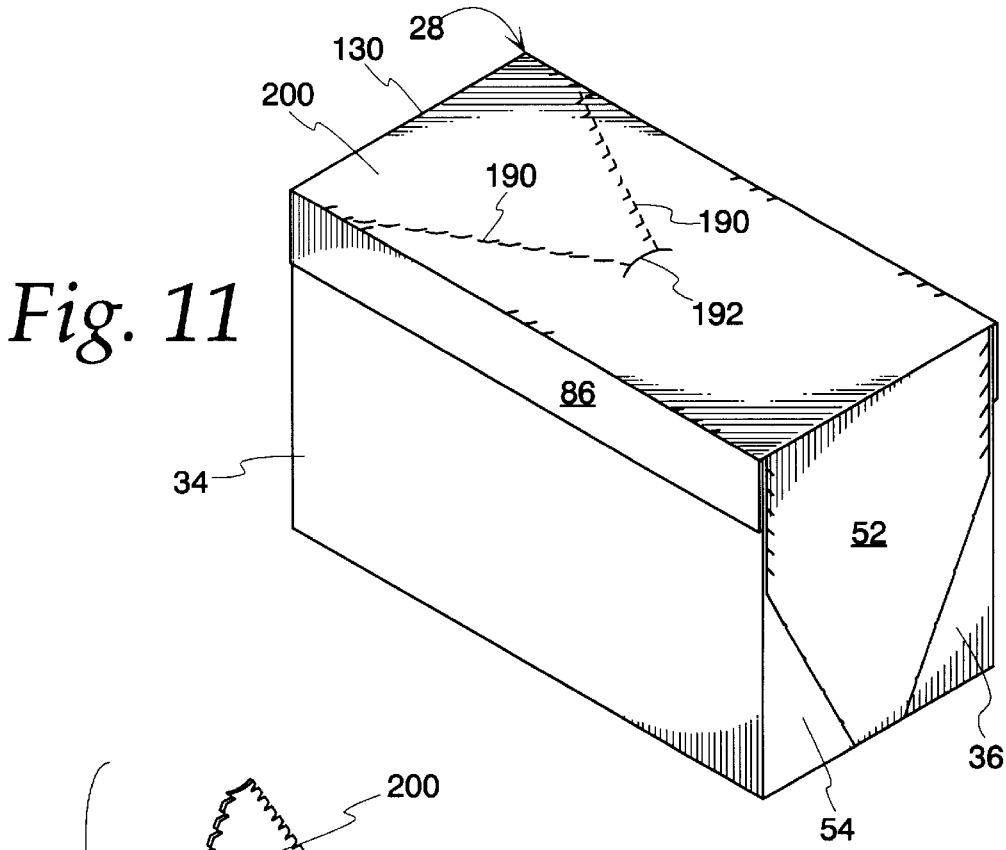
FIG. 11 is a perspective view of a carton arrangement having a feed slot feature.
Figure 12:
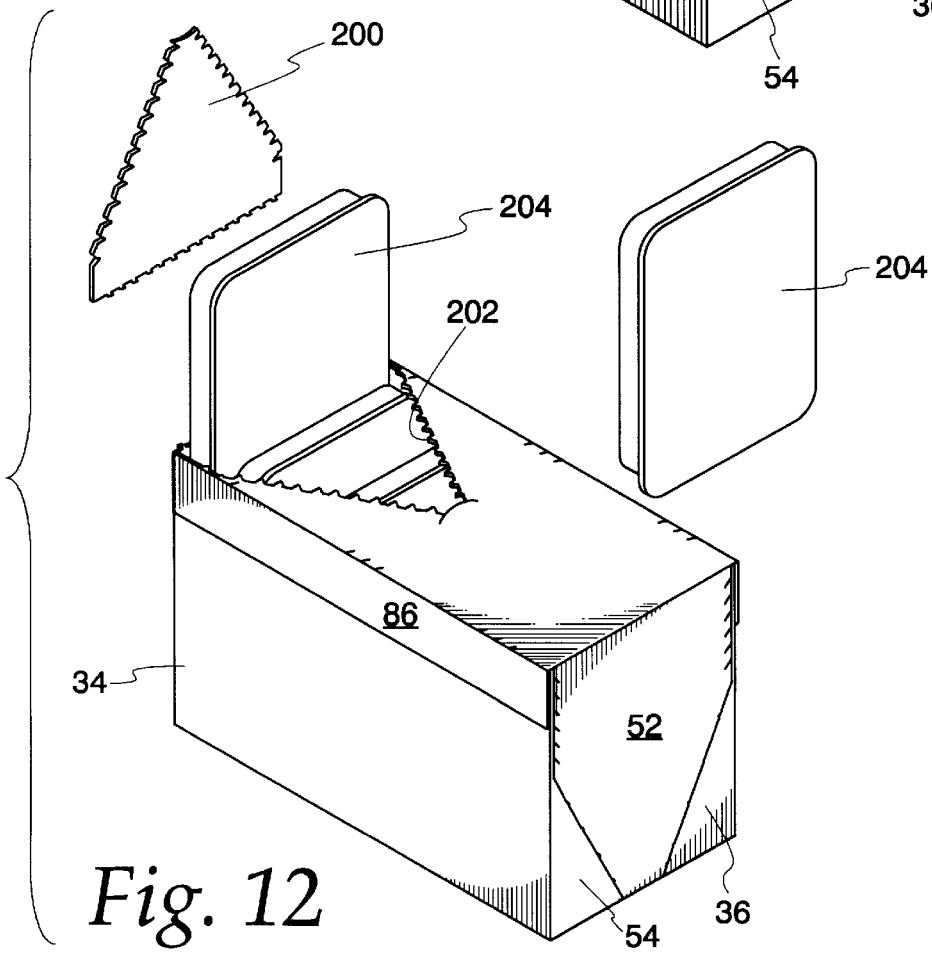
FIG. 12 is a view thereof showing the carton arrangement in use.

Referring to FIGS. 11 and 12, a single-unit carton is shown with an optional feed slot arrangement. A series of perforations 190 and an arcuate cut portion 192 are provided in the cover panel to form a generally triangular tear-out panel 200. As indicated in FIG. 12, this forms an opening or feed slot 202 to gain access to the interior of the carton, allowing product units 204 to be removed or inserted, as required. If desired, the feed slot can be used with dual unit cartons (see FIG. 1, for example).

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carton for display and shipping of product units, comprising:

carton portions disposed side-by-side, each said carton portion having opposed side walls, opposed front and back walls and a bottom wall, cooperating to form an open top receptacle;

said carton portion front walls including removable panels;

a monolithic lid member including a front wall covering the front walls of said carton portions, an opposed back wall covering the back walls of said carton portions, and a top wall covering said carton portions;

said front wall of said lid member including a first removable zipper strip partially covering the front walls of the said carton portions;

said back wall of said lid member including a second removable zipper strip partially covering the back walls of the said carton portions; and said lid member top wall defining a line of weakness generally aligned with adjacent, side-by-side sidewalls of said carton portions, so that, with removal of said first and said second zipper strips, and tearing along said line of weakness, individual closed carton members are formed.

2. The carton of claim 1 wherein the front wall of said lid member includes a pair of spaced-apart recesses exposing respective portions of the front walls of said carton portions.

3. The carton of claim 2 wherein the removable panels of said carton portions include respective pull tabs which are exposed by said recesses of said lid member front wall so that, with the removable zipper strip of said lid member front wall removed, tension on said pull tab removes said lid member front wall and said removable panel, exposing the interior of said receptacle.

4. The carton of claim 2 wherein the removable panels of said carton portions include respective pull tabs which are exposed by the recesses of said lid member front wall and the carton further comprises adhesive securing the removable panels to the pull tabs, so that, with the removable zipper strip of said lid member front wall removed, the pull tab and the removable panel are removed together.

5. The carton of claim 1 wherein said zipper strip is formed by a series of cuts forming sawtooth edges when said zipper strips are removed.

6. The carton of claim 5 wherein said zipper strips have free ends and recesses are formed at the free ends of said zipper strips, on each side of said zipper strips.

7. The carton of claim 6 wherein said zipper strips extend to a point adjacent said lid member top wall.

8. The carton of claim 1 further comprising a line of weakness extending between said back wall and said top wall of said lid member.

9. The carton of claim 1 further comprising a pair of opposed side margins partially covering a side wall of each carton portion.

10. A carton for display and shipping of product units, comprising:

carton portions disposed side-by-side, each said carton portion having opposed side walls, opposed front and back walls and a bottom wall, cooperating to form an open top receptacle;

said carton portion front walls including removable panels;

a monolithic lid member including a front wall covering the front walls of said carton portions, an opposed back wall covering the back walls of said carton portions, a top wall covering said carton portions, and a pair of opposed side margins partially covering a side wall of each carton portion;

said front wall of said lid member including a first removable zipper strip partially covering the front walls of the said carton portions;

said back wall of said lid member including a second removable zipper strip partially covering the back walls of the said carton portions; and said lid member top wall defining a line of weakness generally aligned with adjacent, side-by-side sidewalls of said carton portions, so that, with removal of said first and said second zipper strips, and separation along said line of weakness, individual closed carton members are formed.

11. The carton of claim 10 wherein said zipper strips extend to a point adjacent said lid member top wall.

12. The carton of claim 10 further comprising a line of weakness extending between said back wall and said top wall of said lid member.

13. The carton of claim 10 wherein said zipper strip is formed by a series of cuts forming sawtooth edges when said zipper strips are removed.

14. The carton of claim 13 wherein said zipper strips have free ends and recesses are formed at the free ends of said zipper strips, on each side of said zipper strips.

15. The carton of claim 10 wherein the front wall of said lid member includes a pair of spaced-apart recesses exposing respective portions of the front walls of said carton portions.

16. The carton of claim 15 wherein the removable panels of said carton portions include respective pull tabs which are exposed by recesses of said lid member front wall so that, with the removable zipper strip of said lid member front wall removed, tension on said pull tab removes said lid member front wall and said removable panel, exposing the interior of said receptacle.

17. The carton of claim 15 wherein the removable panels of said carton portions include respective pull tabs which are exposed by the recesses of said lid member front wall and the carton further comprises adhesive securing the removable panels to the pull tabs, so that, with the removable zipper strip of said lid member front wall removed, the pull tab and the removable panel are removed together.

18. A carton for display and shipping of product units, comprising:

a carton portion having opposed side walls, opposed front and back walls and a bottom wall, cooperating to form an open top receptacle;

said carton portion front wall including a removable panel;

a monolithic lid member including a front wall covering the front wall of said carton portion, an opposed back wall covering the back wall of said carton portion, a top wall covering said carton portion, and a pair of opposed side margins partially covering the side wall of said carton portion;

the front wall of said lid member joined to said removable panel; and said lid member top wall defining lines of weakness generally aligned with sidewalls of said carton portions, so that, with removal of said lid member front wall, said removable panel is removed to form an opening for access to said product units.

19. The carton of claim 18 wherein the front wall of said lid member includes a recess exposing a portion of the removable panel.

20. The carton of claim 19 wherein the removable panel of said carton portion includes a pull tab which is exposed by the recess of said lid member front wall and the carton further comprises adhesive securing the removable panel to the pull tab, so that, the pull tab and the removable panel are removed together.

* * * * *